US008439539B2

(12) United States Patent
Yamamoto

(10) Patent No.: US 8,439,539 B2
(45) Date of Patent: May 14, 2013

(54) LOW-BEAM LAMP UNIT

(75) Inventor: Ippei Yamamoto, Shizuoka (JP)

(73) Assignee: Koito Manufacturing Co., Ltd. (JP)

( * ) Notice: Subject to any disclaimer, the term of this patent is extended or adjusted under 35 U.S.C. 154(b) by 98 days.

(21) Appl. No.: 13/103,248

(22) Filed: May 9, 2011

(65) Prior Publication Data

US 2011/0280029 A1 Nov. 17, 2011

(30) Foreign Application Priority Data

May 17, 2010 (JP) ..... 2010-113282

(51) Int. Cl.
*F21V 7/00* (2006.01)

(52) U.S. Cl.
USPC ..... 362/517; 362/539

(58) Field of Classification Search ..... 362/516–518, 362/538–539
See application file for complete search history.

(56) References Cited

U.S. PATENT DOCUMENTS

2008/0062709 A1* 3/2008 Mochizuki et al. ..... 362/539
2008/0247185 A1* 10/2008 Nakada et al. ..... 362/517

FOREIGN PATENT DOCUMENTS

JP 2003-317513 A 11/2003

* cited by examiner

*Primary Examiner* — Julie Shallenberger
(74) *Attorney, Agent, or Firm* — Cantor Colburn LLP

(57) ABSTRACT

Disclosed is a low-beam lamp unit including an LED, a projector lens disposed on an optical axis, a reflector reflecting light of the LED toward the vicinity of a back focus of the projector lens on a vertical cross section, a shade having a front edge portion disposed in the vicinity of the back focus of projector lens to block a portion of light reflected by the reflector, and a re-reflection surface integrally provided in the back of the front edge portion to re-reflect the portion of reflected light blocked by the shade to the projector lens. In the low-beam lamp unit, at least a portion of the re-reflection surface has a light diffusion portion which is a continuously curved surface that is convex toward the reflector in the vertical cross section.

8 Claims, 6 Drawing Sheets

LOW-BEAM LAMP UNIT

CROSS-REFERENCE TO RELATED APPLICATIONS

This application is based on and claims priority from Japanese Patent Application No. 2010-113282, filed on May 17, 2010, with the Japanese Patent Office, the disclosure of which is incorporated herein in its entirety by reference.

TECHNICAL FIELD

The present disclosure relates to a low-beam lamp unit that forms a low-beam light distribution pattern with an improved visibility for a driver.

BACKGROUND

A light source unit for a vehicle lamp is disclosed in, e.g., Japanese Patent Application Laid-Open No. 2003-317513 including a reflector having a first reflective surface inside a member having a substantially ellipsoid-of-revolution shape centering on an optical axis extending in the front and back directions of the vehicle, an LED disposed at a first focus at a vertical cross section of the first reflective surface, a projector lens disposed on the optical axis in front of the reflector, and a light control member provided between the LED and the projector lens. The light control member includes a fore-end edge disposed to pass through a second focus of the projector lens, and a third reflective surface formed as a plane connected to the fore-end edge to extend toward the back of the fore-end edge.

As shown in FIG. 3 of Japanese Patent Application Laid-Open No. 2003-317513, the first reflective surface reflects emitted light from the LED to focus the light on a front/back position of the vicinity of the second focus of the back side of the projector lens within the vertical cross section. The reflected light, which has been reflected to the front side of the second focus and has passed through the fore-end edge of the light control member, is emitted from the projector lens to the front side of the vehicle to form a low-beam light distribution pattern including predetermined horizontal and inclined cut-off lines. Meanwhile, in the light source unit disclosed in Japanese Patent Application Laid-Open No. 2003-317513, light which has been reflected to the back side of the second focus and has been blocked by the fore-end edge of the light control member is also re-reflected upwardly by the third reflective surface to enter into the projector lens, and the light forms the low-beam light distribution pattern together with the light having passed through the fore-end edge of the light control member, minimizing the loss of light.

Since the lamp unit disclosed in Japanese Patent Application Laid-Open No. 2003-317513 re-reflects the light having been blocked by the light control member (light blocking shade) by the third reflective surface to use the re-reflected light for the low-beam light distribution pattern, the loss of light can be reduced to make the low-beam light distribution pattern brighter. Meanwhile, according to checking the light distribution pattern of Japanese Patent Application Laid-Open No. 2003-317513, it has been found out that since the third reflective surface is a horizontal surface in the lamp unit, the re-reflected light is intensively reflected at an upper area of the low-beam light distribution pattern.

With respect to the light flux entering into the third reflective surface to be focused in the vertical cross section, since the third reflective surface is a horizontal plane, the reflection angle of the light having been re-reflected by the fore-end edge of the light control member (hereinafter, simply referred to as a re-reflected beam) is at the maximum, and the reflection angle decreases as the reflection position of the re-reflected beam approaches the back. Therefore, the light flux entering into the third reflective surface is not re-reflected toward a further upper side as compared to the re-reflected light by the fore-end edge of the light control member. Meanwhile, since an image of the light flux by the third reflective surface is turned upside down by the projector lens, the re-reflected beam by the fore-end edge of the light control member is irradiated at the lowest position on the image of the light flux, and the re-reflected light flux is irradiated onto the further upper side as compared to the re-reflected beam by the fore-end edge. Therefore, in the lamp unit disclosed in Japanese Patent Application Laid-Open No. 2003-317513, it is considered that the beam re-reflected by the fore-end edge of the light control member is irradiated on the upper area of the low-beam light distribution pattern, and the light flux of the re-reflected light is intensively reflected to the upper area of the low-beam light distribution pattern.

In a case where the light flux of the re-reflected light by the third reflective surface is intensively reflected to the upper area of the low-beam light distribution pattern, the upper area of the light distribution pattern close to the cutoff line become relatively brighter, while the lower area of the light distribution pattern which has not been subject to light supplement looks darker. Therefore, there exists a large difference in brightness between the upper and lower areas of the low-beam light distribution pattern. The low-beam light distribution pattern having the large difference in brightness as described above makes it difficult for a driver to see the right front side of the low-beam irradiation area, causing a visibility problem for the driver.

SUMMARY

The present disclosure has been made in an effort to provide a low-beam lamp unit which does not cause a large difference in brightness in a low-beam light distribution pattern, and improves the visibility for a driver, by using the beam blocked by a shade to supplement the low-beam light distribution.

According to an embodiment, there is provided a low-beam lamp unit including: a light emitting diode (LED) serving as a light source; a projector lens disposed on an optical axis extending in the front and back directions of a vehicle; a reflector having a reflective surface covering the LED to reflect light of the LED toward the vicinity of a back focus of the projector lens on a vertical cross section of the reflective surface; a shade having a front edge portion disposed in the vicinity of the back focus of the projector lens to block a portion of light reflected by the reflector; and a re-reflection surface integrally provided in the back side of the front edge portion of the shade to re-reflect a portion of reflected light blocked by the shade to the projector lens. In the low-beam lamp unit, at least a portion of the re-reflection surface has a light diffusion portion with a vertical cross section being a continuously curved surface that is convex toward the reflector.

The emitted light of the LED is reflected by the reflector toward the vicinity of the back focus of the projector lens where the front edge portion of the shade is disposed, and a portion of reflected light passing through the shade enters into the projector lens. A portion of reflected light blocked by the shade and entered into the re-reflection surface is re-reflected toward the projector lens. Since a light flux re-reflected by the light diffusion portion of the re-reflection surface is diffused over an upper area to a lower area of the low-beam light distribution pattern, a difference in brightness does not occur between the upper and lower areas of the low-beam light distribution pattern, even though the re-reflected light by the re-reflection surface supplements the low-beam light distribution pattern.

That is, since the light diffusion portion is a convex-type continuously curved surface, a beam re-reflected by the light diffusion portion of the re-reflection surface is re-reflected toward an upper side as the reflection position of the beam approaches the back, unlike a case where the re-reflection surface is a horizontal surface. In other words, a light flux re-reflected toward the projector lens by the re-reflection surface including the convex-type continuously curved surface is diffused toward the further upper side as compared to a light flux re-reflected by a horizontal re-reflection surface. Further, since an image of the re-reflected light flux is turned upside down by the projector lens, the re-reflected light flux is diffused toward not only the upper area but also the lower area in the low-beam light distribution pattern. As a result, even though the low-beam light distribution pattern is supplemented by the re-reflection light, a difference in brightness does not occur between the upper area and the lower area of the low-beam light distribution pattern.

In the low-beam lamp unit described above, the light diffusion portion may be formed such that the curvature of the continuously curved surface gradually increases the further it goes to the back.

If the curvature of the continuously curved surface gradually increases the further it goes to the back, the reflected light from the reflector entering into the light diffusion portion is reflected toward the father upper side as the incident position approaches the back, as compared to a continuously curved surface having a constant curvature. Therefore, a light flux re-reflected by the light diffusion portion is diffused toward the farther upper side. As a result, since the re-reflected light is diffused toward the farther lower area, in the low-beam light distribution pattern, a difference in brightness does not occur between the upper area and the lower area.

In the low-beam lamp unit described above, the re-reflection surface may include an approximately horizontal surface integrated with the back side of the front edge portion of the shade, and the light diffusion portion may be formed to be continuously connected to the back side of the approximately horizontal surface.

Light reflected by the reflector and entered into the approximately horizontal surface is intensively re-reflected toward the upper area of the low-beam light distribution pattern. That is, in the re-reflection surface, the upper area of the low-beam light distribution pattern is supplemented by the light re-reflected by the approximately horizontal surface, and the lower area of the low-beam light distribution pattern is supplemented by the re-reflected light diffused up and down by the continuously curved surface. As a result, in the formed low-beam light distribution pattern, the lower area is supplemented with light to be brighter without excessively reducing the amount of light of the upper area by diffusion.

In the low-beam lamp unit described above, the re-reflection surface may have a substantially U shape according to the shape of the reflective surface provided inside the reflector as seen from above.

The re-reflection surface is formed in the U shape according to the shape of the reflective surface of the inner circumference of the reflector covering the LED, and thus, light reflected by the reflector easily enters into the re-reflection surface.

According to the embodiments of the present disclosure, light re-reflected by the light diffusion portion is diffused from the upper area to the low area of the low-beam light distribution pattern, such that the low-beam light distribution pattern is supplemented by the re-reflected light without generating a difference in brightness between the upper and lower areas. Therefore, the right front area of the front side of the vehicle is brightly illuminated so as to improve the visibility for the vehicle driver.

Further, the diffusion of the re-reflected light to the lower area of the low-beam light distribution pattern widens, such that the right front area of the front side of the vehicle is more brightly illuminated so as to further improve the visibility of the vehicle driver.

Furthermore, the visibility of the lower area is improved without reducing the visibility of the upper area of the low-beam light distribution pattern so as to further improve the visibility for the driver.

Moreover, the amount of light re-reflected to the projector lens by the re-reflection surface increases so as to more effectively supplement the low-beam light distribution pattern with light. Therefore, the visibility for the driver is still further improved.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

A low-beam lamp unit according to an exemplary embodiment of the present disclosure will be described hereinafter with reference to FIGS. 1 to 6.

Figure 1:
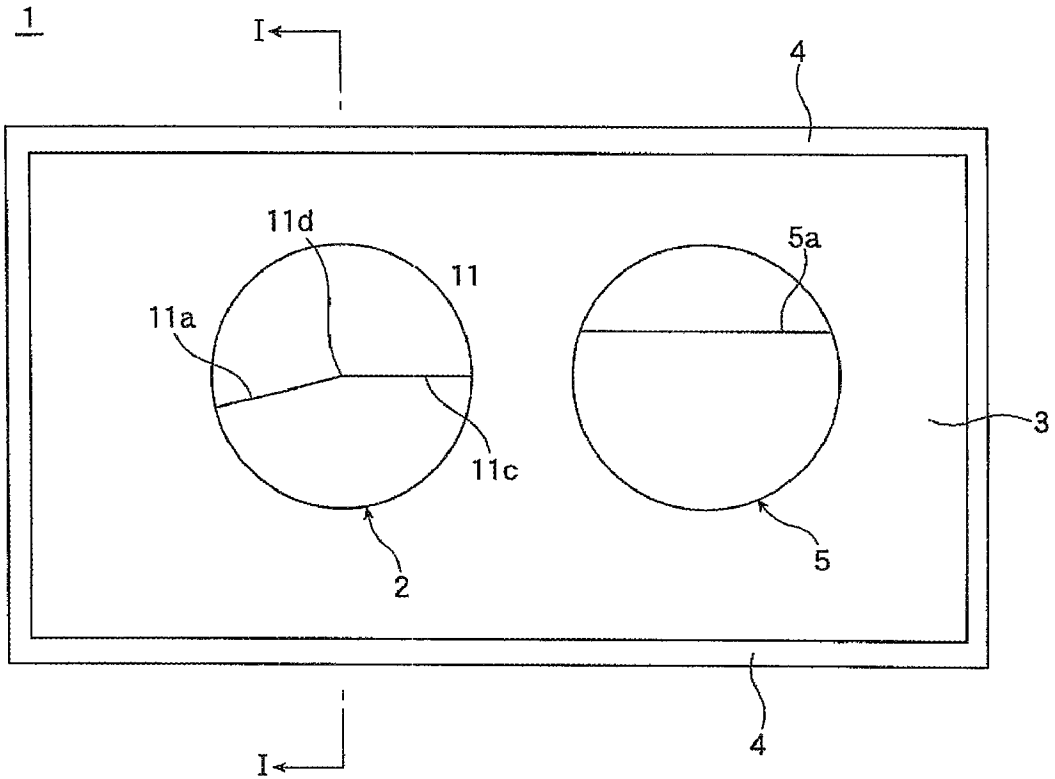
FIG. 1 is a front view illustrating a low-beam lamp unit according to an exemplary embodiment of the present disclosure.

FIG. 1 is a front view illustrating a vehicle lighting 1 including a low-beam lamp unit 2 according to an exemplary embodiment of the present disclosure. Vehicle lighting 1 includes low-beam lamp unit 2, a front cover 3 made of a transparent resin or the like, a lamp body 4, and a low-beam supplement unit 5. Front cover 3 is integrated with lamp body 4, and a lamp room is defined inside lamp body 4. Inside the lamp room, a low-beam lamp unit 2 and a low-beam supplement unit 5 are disposed.

Figure 2:
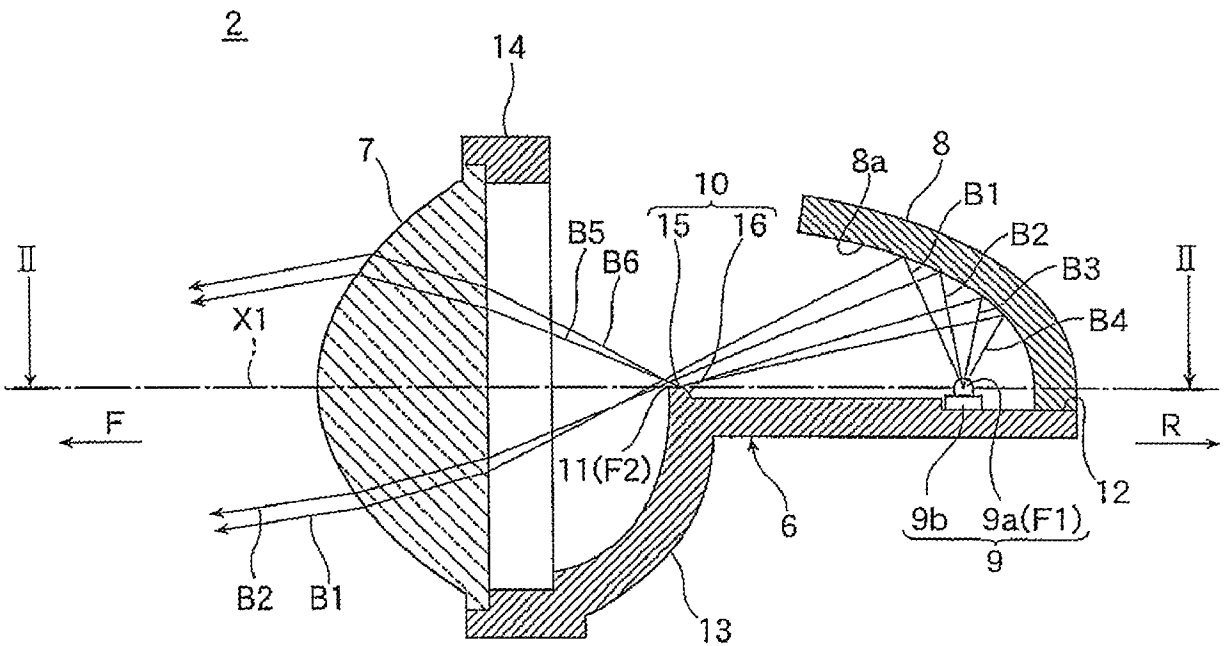
FIG. 2 is a cross-sectional view (vertical cross-sectional view) of FIG. 1 taken along the line I-I.

Low-beam lamp unit 2 includes a shade 6, a projector lens 7, a reflector 8, and a light emitting diode (LED) 9. Further, in the exemplary embodiment, low-beam lamp unit 2 forming a low-beam light distribution pattern of left light distribution will be described on the assumption that the projector lens side of FIG. 2 is the front side (a direction denoted by a reference symbol F) and the reflector side is the back side (a direction denoted by a reference symbol R).

Shade 6 has a flat plate shape, and a re-reflection surface 10 is formed on the top surface of shade 6 by, e.g., an aluminum vapor deposition. Further, a cutoff line formation portion 11 is provided at the front edge portion of the top surface of shade 6, and reflector 8 is integrally fixed to the back end portion of the top surface. Furthermore, a step portion 12 is provided at the back end portion of the top surface of shade 6, and LED 9 is fixed to a step portion 12. Moreover, a curved portion 13 is provided integrally with the front end portion of the bottom surface of shade 6 to extend downward and be curved toward the front side, and a ring-shaped lens holder 14 is provided at the front end portion of curved portion 13 to hold projector lens 7.

Projector lens 7 disposed on an optical axis X1 is composed of a plano-convex aspheric surface in which the front side is a convex curved surface and the back side is a planar surface. Reflector 8 has a substantially half spheroidal surface shape centering on optical axis X1, and has a reflective surface 8*a* inside. The eccentricity of a cross section of reflective surface 8*a* which is a substantially half spheroidal surface gradually increases as the cross section approaches a horizontal cross section from a vertical cross section.

LED 9 includes an LED chip 9*a* and an LED substrate 9*b*, and LED substrate 9*b* is fixed to step portion 12 such that LED chip 9*a* is disposed at a first focus F1 of reflective surface 8*a* of reflector 8.

Cutoff line formation portion 11 provided at the front edge portion of shade 6 includes an inclined cutoff line formation portion 11*a* inclined upward when going from left to right as seen from the front side of low-beam lamp unit 2, and includes two horizontal cutoff line formation portions 11*b* and 11*c* connected to both ends, that is, left and right ends of inclined cutoff line formation portion 11*a*. An interface 11*d* of inclined cutoff line formation portion 11*a* and horizontal cutoff line formation portion 11*c* is disposed to correspond to a back focus (second focus F2) of the projector lens on a vertical cross section. Further, horizontal cutoff line formation portions 11*b* and 11*c* are formed to be curved forward from inclined cutoff line formation portion 11*a* on a horizontal cross section shown in FIG. 5, and cutoff line formation portion 11 has a substantially U shape according to reflective surface 8*a* as seen from the upside to the front side (in the F direction in FIG. 5).

Figure 4:
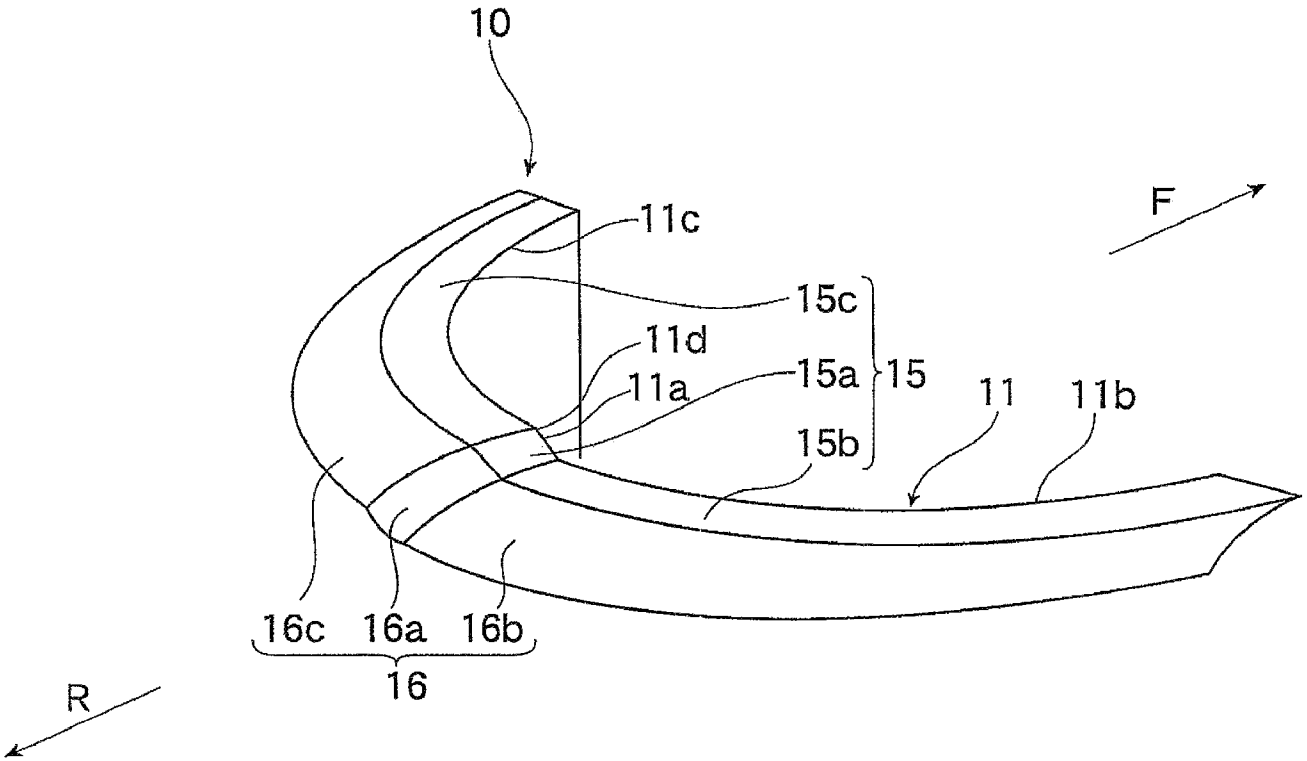
FIG. 4 is a partial perspective view illustrating the re-reflection surface of the shade.
Figure 5:
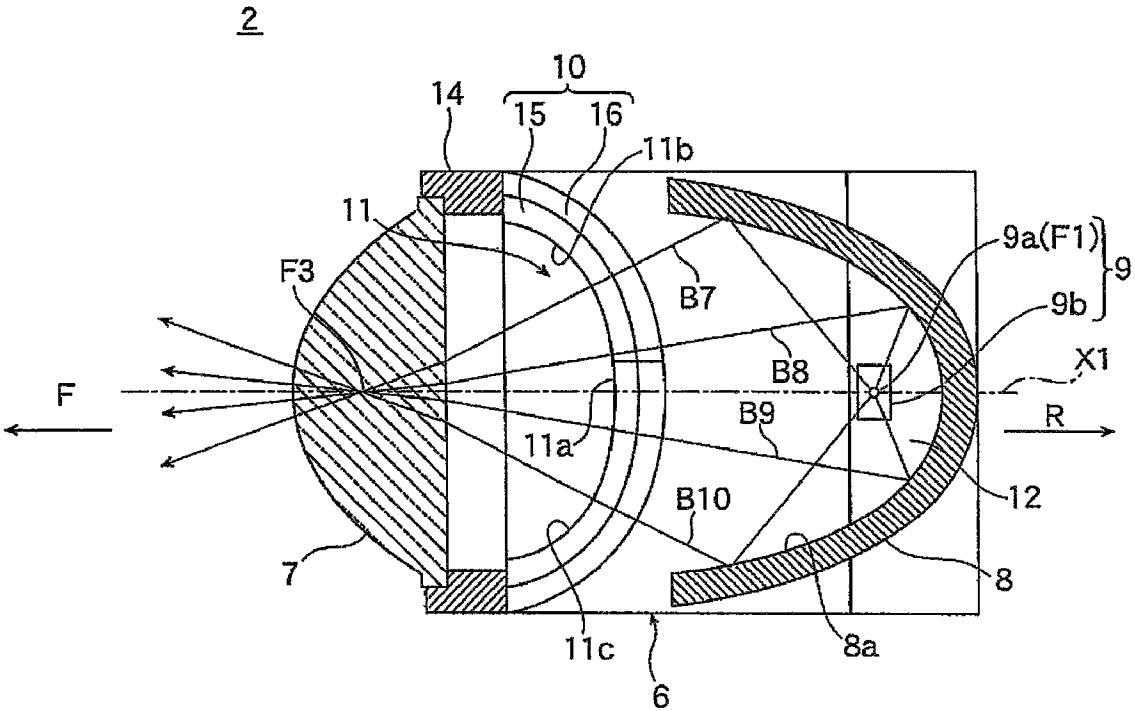
FIG. 5 is a cross-sectional view (horizontal cross-sectional view) of FIG. 2 taken along the line II-II.

Re-reflection surface 10 includes an approximately horizontal surface 15 extending from the back end portions of inclined and horizontal cutoff line formation portions 11*a* to 11*c* to the back along optical axis X1, and a light diffusion portion 16 continuously connected to the back end portion of approximately horizontal surface 15, as shown in FIGS. 4 and 5. Approximately horizontal surface 15 includes an inclined surface 15*a* extending toward the back with the same slope as inclined cutoff line formation portion 11*a*, and horizontal surfaces 15*b* and 15*c* continuously connected to the left and right of inclined surface 15*a*. Light diffusion portion 16 is a convex-type continuously curved surface curved from the back end portions of individual flat surfaces 15*a* to 15*c* downward on a vertical cross section of each of inclined surface 15*a* and horizontal surfaces 15*b* and 15*c*. Further, re-reflection surface 10 has a substantially U shape according to reflective surface 8*a* like cutoff line formation portion 11 of the reflector, as seen from the upside to the front side (in the F direction in FIGS. 4 and 5).

Light diffusion portion 16 according to the exemplary embodiment of the present disclosure is formed as a single convex-type continuously curved surface on a vertical cross section of approximately horizontal surface 15, and does not have a lens step shape in which a plurality of curved surfaces are disposed to be adjacent to each other. The reasons why light diffusion portion 16 is formed as one continuously curved surface are as follows: (a) if a beam is diffused into a plurality of lens steps, the beam intended to enter a target lens step may be interfered by an adjacent lens step immediately before the target lens step (the beam may enter the adjacent lens step), and may not enter the target lens step, such that an incident angle is limited; and (b) if the incident angle is limited, an amount of beam which cannot be re-reflected to the projector lens increases, such that the amount of beam to be used for re-reflection decreases.

Low-beam supplement unit 5 includes a horizontal cutoff line formation portion 5*a* disposed at a position higher than horizontal cutoff line formation portion 11*c* of low-beam lamp unit 2 in the shade (not shown) to intensively supplement a lower area of a low-beam light distribution pattern with light.

Figure 3:
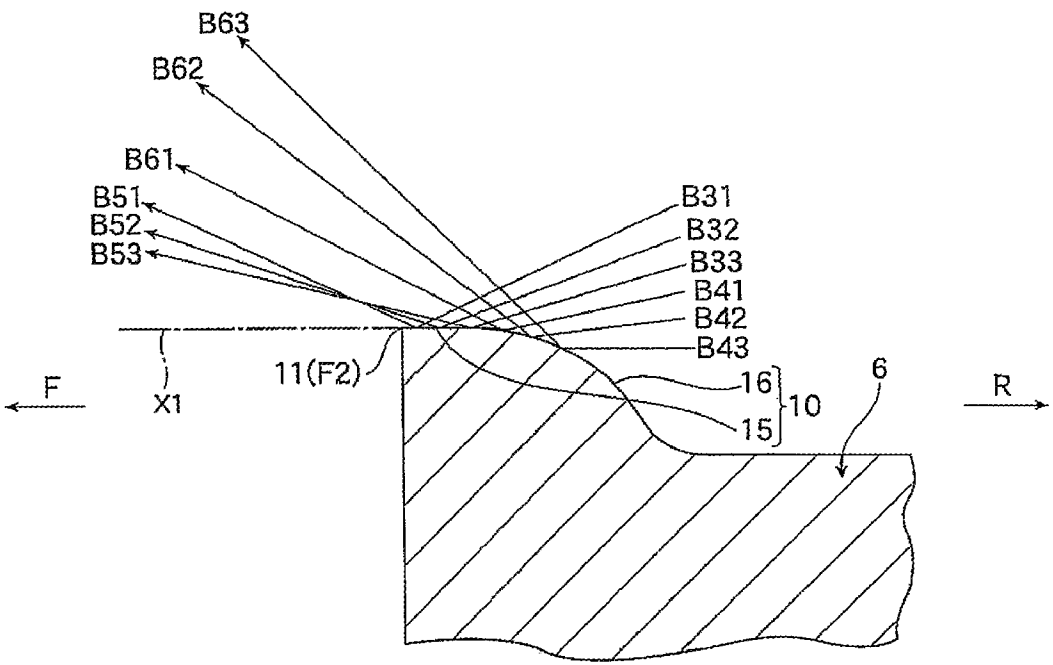
FIG. 3 is an enlarged cross-sectional view of FIG. 2 relative to a re-reflection surface of a shade.

Next, a light path of the low-beam lamp unit and a light distribution pattern will be described with reference to FIGS. 2, 3, and 5. As shown in FIG. 2, light emitted from LED chip 9*a* disposed at the first focus of reflector 8 in a vertical cross section is reflected by reflective surface 8*a* in the vertical cross section to be focused on the vicinity of the back second focus of projector lens 7. If beams of the reflected light are denoted by B1 to B4, beams B1 and B2 pass through shade 6 without being blocked by the inclined and horizontal cutoff line formation portions 11 to be focused, and then, are diffused upward and downward.

Further, beam B3 reflected by the reflector is re-reflected by approximately horizontal surface 15 to enter into projector lens 7 as a re-reflected beam B5. Meanwhile, a portion of reflected beam B4 is re-reflected by light diffusion portion 16 to enter into projector lens 7 as a re-reflected beam B6.

Meanwhile, as shown in FIG. 5, if beams emitted from LED chip 9*a* disposed at the first focus of reflector 8 in the horizontal cross section and reflected by reflective surface 8*a* are denoted by reflected beams B7 to B10, reflected beams B7 to B10 are focused on the vicinity of a third focus F3 in projector lens 7 by reflective surface 8*a* having the larger eccentricity in a horizontal cross section than in the vertical cross section, are diffused again into left and right sides, and are then emitted to the front side of projector lens 7.

Next, beams entering into re-reflection surface 10 in the vertical cross section will be described in detail with reference to FIG. 3. In the following description, light fluxes corresponding to reflected beam B3 entering into approximately horizontal surface 15 are denoted by B31 to B33 sequentially from a light flux having the nearest incident position to the cutoff line formation portion of the fore-end portion of the shade, light fluxes corresponding to reflected beam B4 entering into light diffusion portion 16 are denoted by B41 to B43, light fluxes obtained by re-reflecting light fluxes B31 to B33 are denoted by B51 to B53, and light fluxes obtained by re-reflecting light fluxes B41 to B43 are denoted by B61 to B63.

Since light fluxes B31 to B33 reflected by reflector 8 are light fluxes focused toward the vicinity of cutoff line formation portion 11 (the second focus) and enter into approximately horizontal surface 15 while generating a deviation forward and backward, the incident angle (=reflection angle) to approximately horizontal surface 15 increases as the incident position shifts back. As a result, in light fluxes B51 to B53 re-reflected by approximately horizontal surface 15 and diffused, as shown in FIG. 3, light flux B51 reflected from the closest position to cutoff line formation portion 11 of the front edge portion is reflected toward the uppermost, and light fluxes B52 and B53 re-reflected from the farther back side than light flux B51 are reflected toward the further lower side as compared to light flux B51. In other words, light fluxes B52 and B53 re-reflected by approximately horizontal surface 15 are diffused toward the further lower side than light flux B51.

Meanwhile, light diffusion portion 16 is a convex-type continuously curved surface continuously connected to the back side of approximately horizontal surface 15 and curved downward. Therefore, in a case where light fluxes B41 to B43 focused toward the front side enter into light diffusion portion 16, with respect to light fluxes B61 to B63 re-reflected by light diffusion portion 16, a light flux having an incident position on the farther back side is reflected toward the upper side on the basis of the curvature of the light diffusion portion. In other words, light fluxes B62 and B63 re-reflected by light diffusion portion 16 are diffused toward the further upper side as compared to light flux B61, as shown in FIG. 3. Light fluxes B61 to B63 are more largely diffused upward as the curvature of light diffusion portion 16 increases.

An image of light fluxes emitted from projector lens 7 toward the front side is turned upside down and mirror-reversed by projector lens 7. Therefore, light fluxes B51 to B53 diffused downward before entering into projector lens 7 are diffused upward by projector lens 7, and light fluxes B61 to B63 diffused upward before entering into projector lens 7 are diffused downward by projector lens 7. Further, since light fluxes B61 to B63 emitted from projector lens 7 toward the front side are diffused farther downward as the curvature of the light diffusion portion increases, the downward diffusion can be adjusted by adjusting the curvature of light diffusion portion 16 in the exemplary embodiment of the present disclosure.

Figure 6:
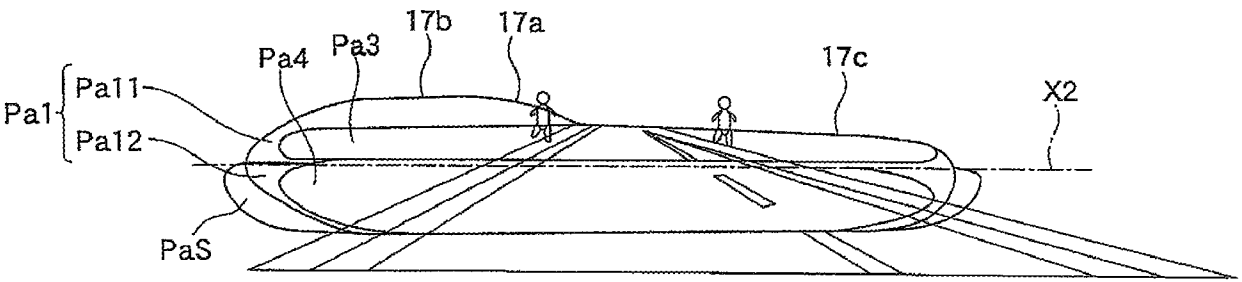
FIG. 6 is an explanatory view of a light distribution pattern of the low-beam lamp unit.

FIG. 6 shows a light distribution pattern of the vehicle lighting according to the exemplary embodiment of the present disclosure. A low-beam light distribution pattern Pa1 represents a light distribution pattern by low-beam lamp unit 2 according to the exemplary embodiment of the present disclosure, and a low-beam light distribution pattern PaS represents a light distribution pattern of low-beam supplement unit 5.

An upper edge portion of light distribution pattern Pa1 has a shape in which a horizontal cutoff line 17*b* corresponding to horizontal cutoff line formation portion 11*b*, and a horizontal cutoff line 17*c* corresponding to horizontal cutoff line formation portion 11*c* are continuously connected to both ends of a cutoff line 17*a* formed to correspond to inclined cutoff line formation portion 11*a* and be inclined downward when going from left to right. Further, if a horizontal line dividing low-beam light distribution pattern Pa1 into two, that is, an upper area and a lower area is denoted by X2, the upper area of the low-beam light distribution pattern is denoted by Pa11, and the lower area thereof is denoted by Pa12, light is distributed to overlap lower area Pa12 in light distribution pattern PaS of low-beam supplement unit 5.

Further, since light fluxes B51 to B53 re-reflected by approximately horizontal surface 15 are not diffused below a predetermined height, light fluxes B51 to B53 supplement upper area Pa11 of light distribution pattern Pa1 so as to form an image denoted by a reference symbol Pa3. Meanwhile, light fluxes B61 to B63 re-reflected by light diffusion portion 16 supplement from upper area Pa11 to lower area Pa12 of light distribution pattern Pa1 according to the curvature of the convex-type continuously curved surface, so as to form an image denoted by a reference symbol Pa4.

For convenience of explanation, in FIG. 6, image Pa4 formed by the re-reflected light of light diffusion portion 16 is shown below image Pa3 formed by the re-reflected light of approximately horizontal surface 15. However, in low-beam lamp unit 2 according to the exemplary embodiment of the present disclosure, it is possible to widely form image Pa4 over upper area Pa11 and lower area Pa12 of light distribution pattern Pa1 by adjusting the curvature of the convex-type continuously curved surface of light diffusion portion 16. Further, although approximately horizontal surface 15 is provided to the reflective surface in the exemplary embodiment of the present disclosure, approximately horizontal surface 15 may not be provided to re-reflection surface 10, and re-reflection surface 10 may be composed of only light diffusion portion 16 including the convex-type continuously curved surface. In this case, it is possible to generally supplement upper and lower areas Pa11 and Pa12 of light distribution pattern Pa1 with light by adjusting the curvature of the convex-type of continuously curved surface. Also, low-beam supplement unit 5 may not be provided.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A low-beam lamp unit, comprising:

an LED serving as a light source;

a projector lens disposed on an optical axis extending along a front and back direction of a vehicle;

a reflector having a reflective surface covering the LED to reflect light of the LED toward a vicinity of a back focus of the projector lens on a vertical cross section;

a shade having a front edge portion disposed in the vicinity of the back focus of the projector lens to block a portion of light reflected by the reflector; and a re-reflection surface integrally protruded from the top surface of the front edge portion of the shade to re-reflect the portion of reflected light blocked by the shade to the projector lens, wherein the re-reflection surface includes a light diffusion portion formed along with the vertical cross section as a single continuously curved surface which is convex toward the reflector.

2. The low-beam lamp unit of claim 1, wherein the light diffusion portion is formed such that a curvature of the continuously curved surface gradually increases the further it goes to the back.

3. The low-beam lamp unit of claim 1, wherein the re-reflection surface includes an approximately horizontal surface integrated with the back of the front edge portion of the shade, and the light diffusion portion is formed to be continuously connected to the back of the approximately horizontal surface.

4. The low-beam lamp unit of claim 2, wherein the re-reflection surface includes an approximately horizontal surface integrated with the back of the front edge portion of the shade, and the light diffusion portion is formed to be continuously connected to the back of the approximately horizontal surface.

5. The low-beam lamp unit of claim 1, wherein the re-reflection surface has a substantially U shape according to the shape of the reflective surface provided inside the reflector as seen from an above.

6. The low-beam lamp unit of claim 2, wherein the re-reflection surface has a substantially U shape according to the shape of the reflective surface provided inside the reflector as seen from an above.

7. The low-beam lamp unit of claim 3, wherein the re-reflection surface has a substantially U shape according to the shape of the reflective surface provided inside the reflector as seen from an above.

8. The low-beam lamp unit of claim 4, wherein the re-reflection surface has a substantially U shape according to the shape of the reflective surface provided inside the reflector as seen from an above.

* * * * *